US006926624B1

(12) United States Patent
Witzke

(10) Patent No.: US 6,926,624 B1
(45) Date of Patent: Aug. 9, 2005

(54) HOCKEY PRACTICE SYSTEM

(76) Inventor: John F. Witzke, 624 N. 21st St., Bismarck, ND (US) 58501

( * ) Notice: Subject to any disclaimer, the term of this patent is extended or adjusted under 35 U.S.C. 154(b) by 0 days.

(21) Appl. No.: 10/733,041

(22) Filed: Dec. 10, 2003

(51) Int. Cl.[7] ..... A63B 69/00
(52) U.S. Cl. ..... 473/446; 446/118
(58) Field of Search ..... 473/446, 422, 473/415, 459; 273/400; D21/699; 446/118

(56) References Cited

U.S. PATENT DOCUMENTS

| | | | | |
|---|---|---|---|---|
| 3,061,947 | A * | 11/1962 | Faudree | 434/205 |
| 3,280,499 | A * | 10/1966 | Studen | 446/118 |
| 3,794,318 | A | 2/1974 | Holmes | |
| 3,840,228 | A | 10/1974 | Greaney | |
| 3,856,298 | A | 12/1974 | Frantti | |
| 3,887,181 | A | 6/1975 | Samaras | |
| 4,168,062 | A | 9/1979 | McCarthy et al. | |
| 4,245,843 | A * | 1/1981 | Griggs | 473/446 |
| 4,492,380 | A | 1/1985 | Saytar | |
| 4,607,842 | A | 8/1986 | Daoust | |
| 4,842,283 | A * | 6/1989 | LeBel et al. | 273/392 |
| 5,000,461 | A * | 3/1991 | Borazjani | 273/401 |
| 5,238,243 | A | 8/1993 | Grispi | |
| 5,246,229 | A | 9/1993 | Carey | |
| 5,509,650 | A | 4/1996 | MacDonald | |
| 5,628,515 | A * | 5/1997 | Levy | 473/446 |
| 5,634,640 | A | 6/1997 | McCarrel | |
| 5,707,304 | A | 1/1998 | BelleIsle | |
| 5,752,701 | A * | 5/1998 | Kao | 273/269 |
| 5,772,538 | A * | 6/1998 | Sztykiel et al. | 473/446 |
| 5,888,153 | A * | 3/1999 | Masin | 473/446 |
| 5,954,600 | A * | 9/1999 | Gill | 473/478 |
| 6,082,386 | A | 7/2000 | Zheng | |
| 6,089,568 | A | 7/2000 | Milici | |
| 6,250,634 | B1 | 6/2001 | Strain et al. | |
| 6,508,729 | B1 | 1/2003 | Coltrane et al. | |
| 2002/0151387 | A1 | 10/2002 | Henson | |
| 2003/0066553 | A1 | 4/2003 | Zheng | |

FOREIGN PATENT DOCUMENTS

| | | |
|---|---|---|
| WO | WO 99/44694 | 9/1999 |

* cited by examiner

*Primary Examiner*—Gregory Vidovich
*Assistant Examiner*—M. Chambers

(57) ABSTRACT

A hockey practice system for improving a hockey player's shooting skills in an entertaining manner. The hockey practice system includes a panel having a plurality of openings, a first support and a second support pivotally attached to the sides of the panel, and a plurality of targets removably positionable within the openings. The targets are preferably comprised of a resilient material for frictionally engaging within the openings of the panel. A goalie member may be attached to the front of the panel.

3 Claims, 7 Drawing Sheets

HOCKEY PRACTICE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a hockey shooting skills practice apparatus and more specifically it relates to a hockey practice system for improving a hockey player's shooting skills in an entertaining manner.

2. Description of the Related Art

Hockey players typically practice by shooting at an empty hockey goal or against a wall. There has been previously attempted puck shooting ranges (U.S. Pat. No. 5,707,304), target assemblies (U.S. Pat. No. 4,842,283) and panel silhouettes positionable in front of a hockey goal (U.S. Pat. No. 4,168,062).

While these devices may be suitable for the particular purpose to which they address, they are not as suitable for improving a hockey player's shooting skills in an entertaining manner. Conventional hockey shooting practice devices do not simultaneously provide entertainment while encouraging the hockey player to aim for specific locations of the goal.

In these respects, the hockey practice system according to the present invention substantially departs from the conventional concepts and designs of the prior art, and in so doing provides an apparatus primarily developed for the purpose of improving a hockey player's shooting skills in an entertaining manner.

BRIEF SUMMARY OF THE INVENTION

In view of the foregoing disadvantages inherent in the known types of hockey shooting practice systems now present in the prior art, the present invention provides a new hockey practice system construction wherein the same can be utilized for improving a hockey player's shooting skills in an entertaining manner.

The general purpose of the present invention, which will be described subsequently in greater detail, is to provide a new hockey practice system that has many of the advantages of the hockey practice devices mentioned heretofore and many novel features that result in a new hockey practice system which is not anticipated, rendered obvious, suggested, or even implied by any of the prior art hockey practice devices, either alone or in any combination thereof.

To attain this, the present invention generally comprises a panel having a plurality of openings, a first support and a second support pivotally attached to the sides of the panel, and a plurality of targets removably positionable within the openings. The targets are preferably comprised of a resilient material for frictionally engaging within the openings of the panel. A goalie member may be attached to the front of the panel.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a hockey practice system that will overcome the shortcomings of the prior art devices.

A second object is to provide a hockey practice system for improving a hockey player's shooting skills in an entertaining manner.

Another object is to provide a hockey practice system that is portable.

An additional object is to provide a hockey practice system that is easy to setup, use and store.

A further object is to provide a hockey practice system that assists a hockey player in developing their shooting techniques and accuracy (e.g. shot release, shot follow through).

Another object is to provide a hockey practice system that creates a fun and entertaining environment for practicing a hockey player's shooting skills.

A further object is to provide a hockey practice system that may be utilized in either an ice rink or a non-ice environment.

Another object is to provide a hockey practice system that does not require a second person to serve as a goalie.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
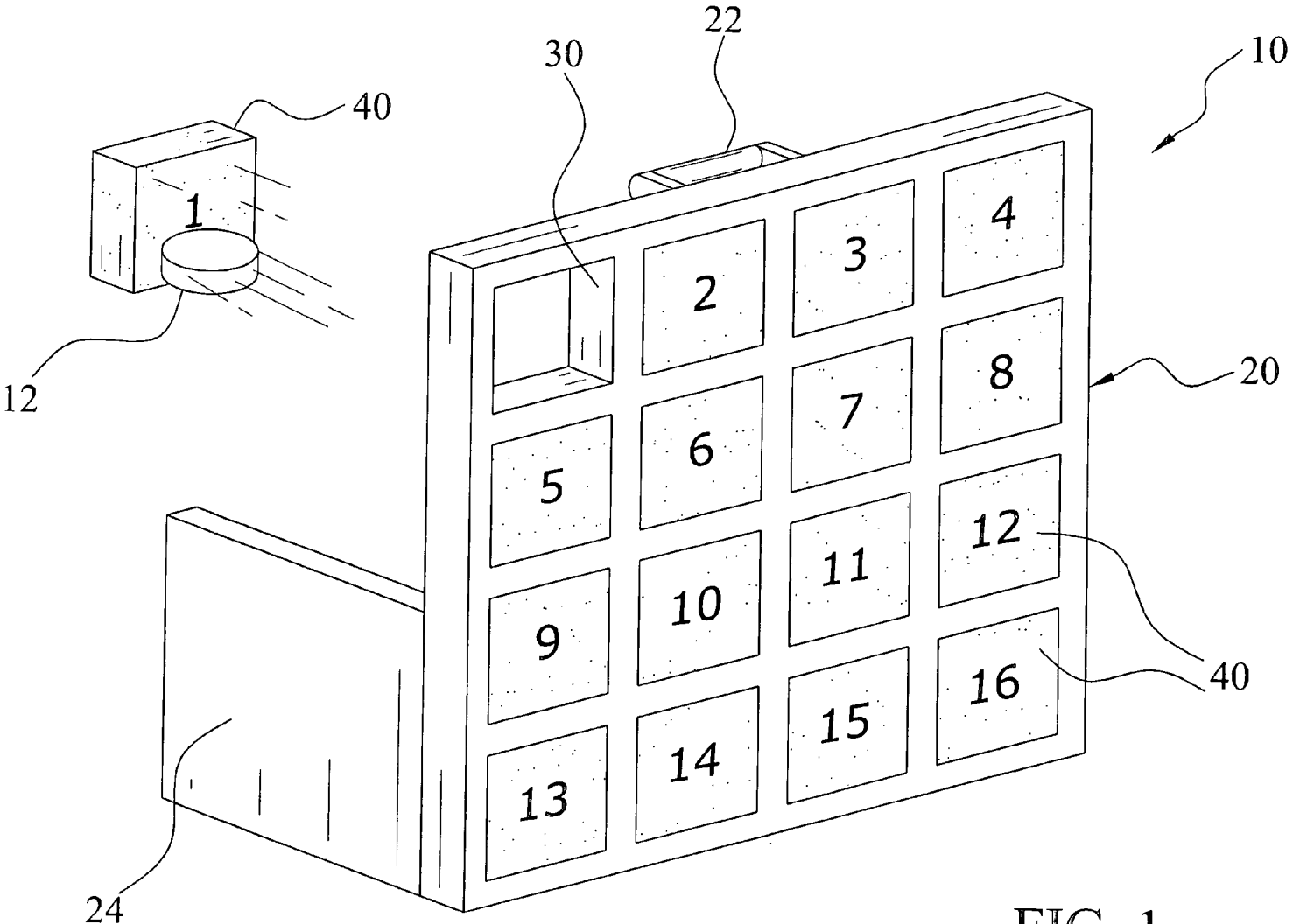
FIG. 1 is an upper perspective view of the present invention with a target being removed by a puck.

Turning now descriptively to the drawings, in which similar reference characters denote similar elements throughout the several views, FIGS. 1 through 8 illustrate a hockey practice system 10, which comprises a panel 20 having a plurality of openings 30, a first support 24 and a second support 26 pivotally attached to the sides of the panel 20, and a plurality of targets 40 removably positionable within the openings 30. The targets 40 are preferably comprised of a resilient material for frictionally engaging within the openings 30 of the panel 20. A goalie member 50 may be attached to the front of the panel 20.

B. Panel

FIGS. 1 through 4 best illustrate the panel 20. The panel 20 is preferably positionable in an upright substantially vertical position as shown in FIGS. 1, 2, 3 and 7 of the drawings. The panel 20 may be comprised of a any conventional rigid material such as but not limited to plastic, metal, composite, wood or the like.

Figure 3:
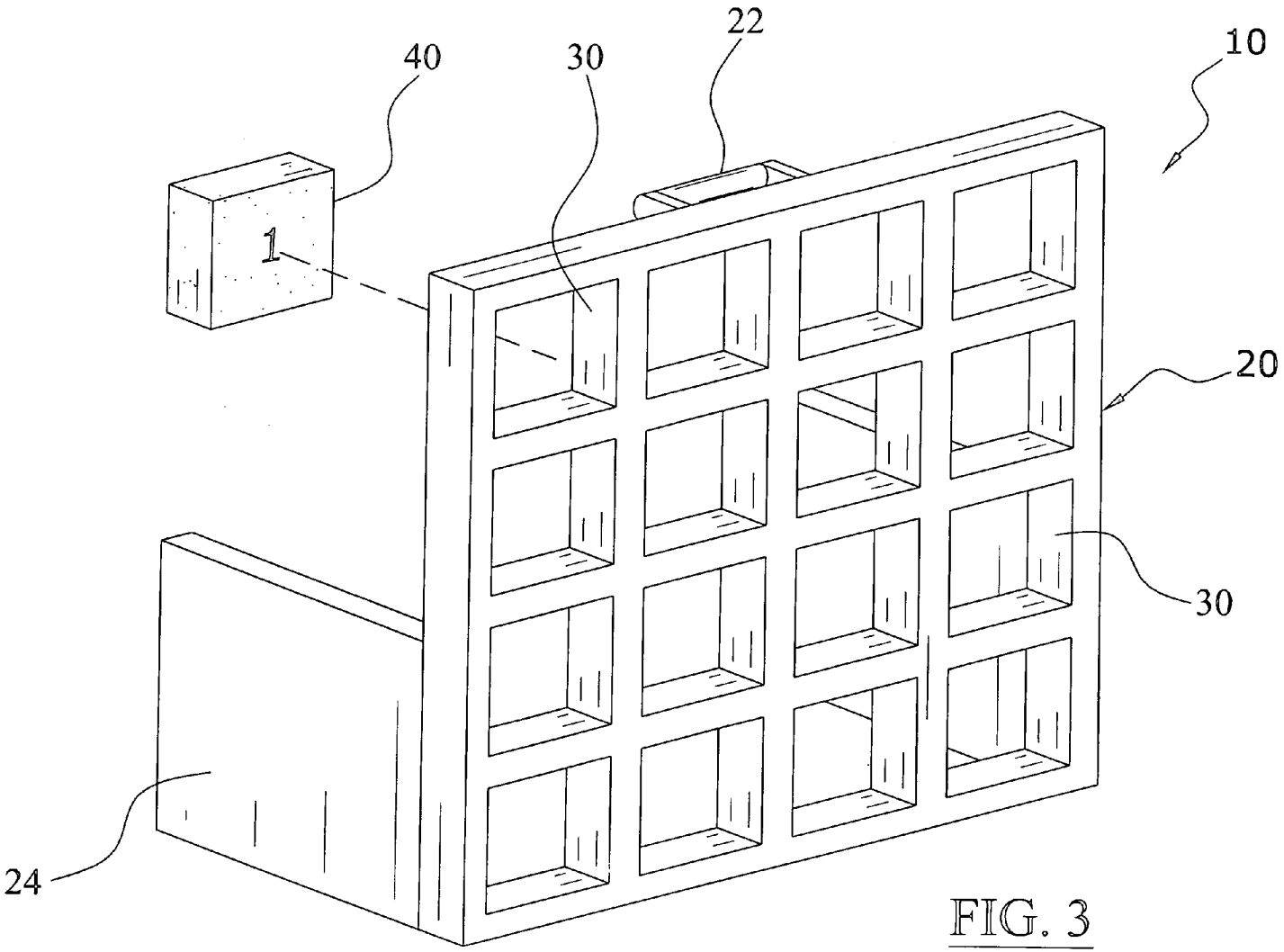
FIG. 3 is an upper perspective view of the present invention with the targets removed.

The panel 20 includes a plurality of openings 30 as best shown in FIG. 3 of the drawings. The openings 30 may have various shapes, however it is preferable to have the opening comprised of a square shape. The openings 30 are preferably sufficient in size to allow a puck 12, ball or other object being engaged with a hockey stick to pass through as shown in FIG. 1 of the drawings.

Figure 8:
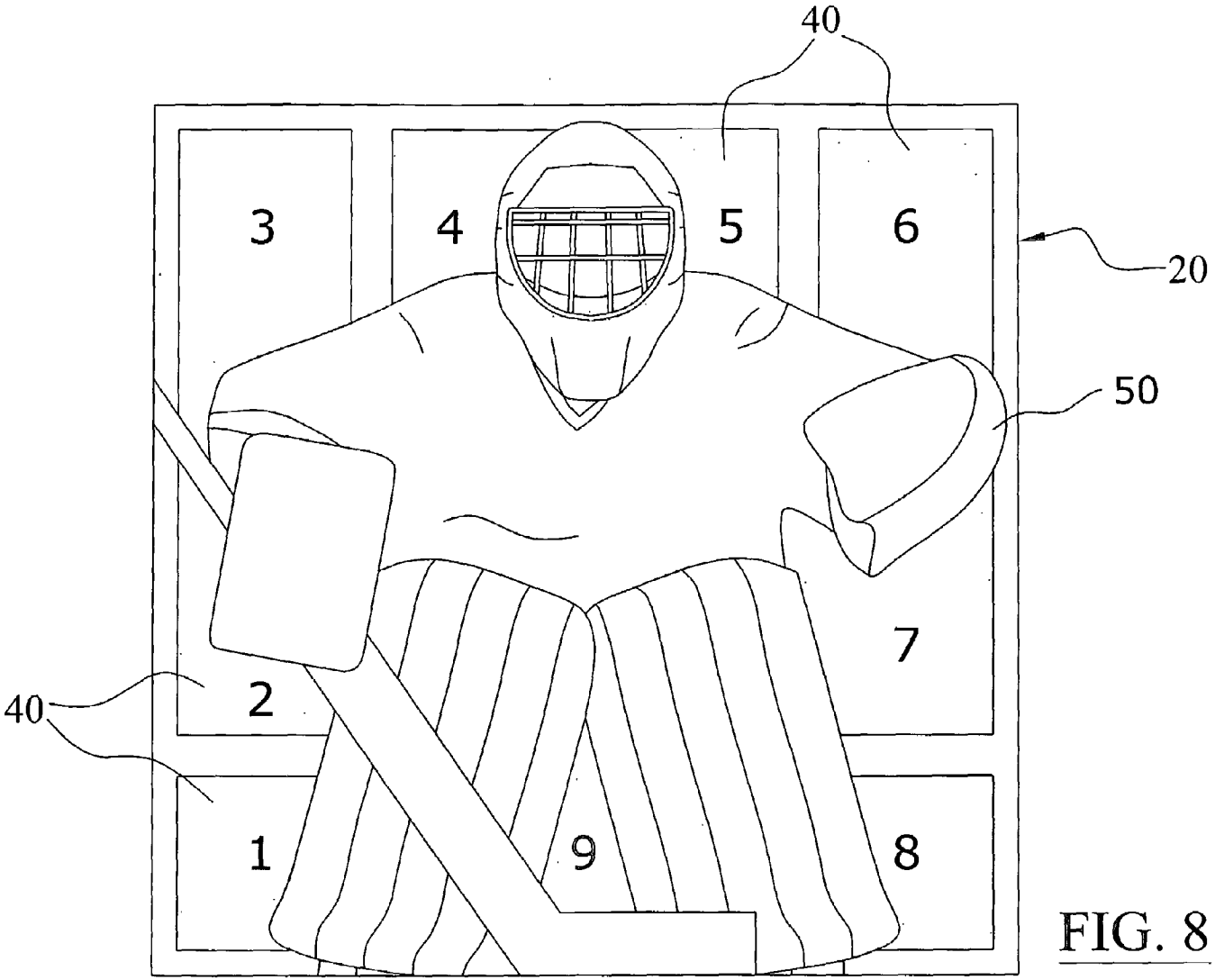
FIG. 8 is a front view of an alternative embodiment illustrating a goalie figure in front of the panel.

The plurality of openings 30 are preferably comprised of at least two vertical rows and/or at least two horizontal rows as shown in FIG. 3 of the drawings. Other configurations for the openings 30 may be achieved depending upon the purpose as shown in FIG. 8 wherein the goalie member 50 covers a portion of the openings 30. FIG. 3 illustrates that it is preferable that 16 openings 30 extend through the panel 20 forming a 4×4 structure.

FIGS. 1, 2, 3, 5 and 7 illustrate a handle 22 preferably attached to an upper portion of the panel 20. The handle 22 may be grasped by the user to transport the panel 20 to various locations. The handle 22 may have various structures other than illustrated in the drawings.

C. Supports

Figure 5:
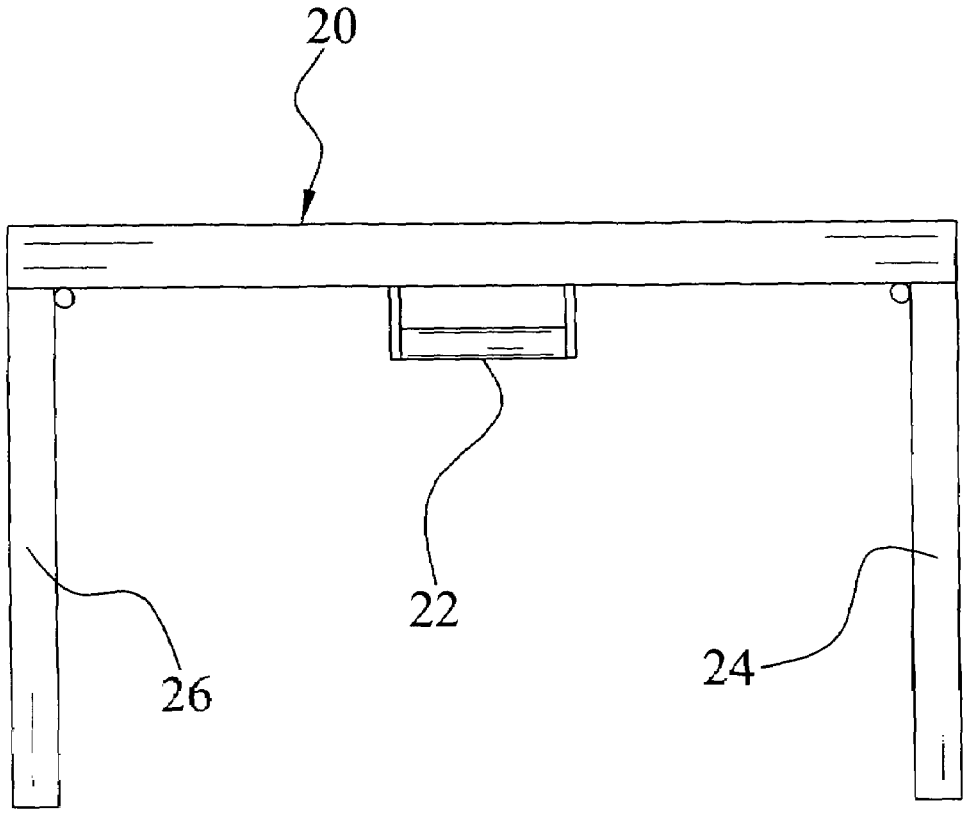
FIG. 5 is a top view of the present invention.
Figure 6:
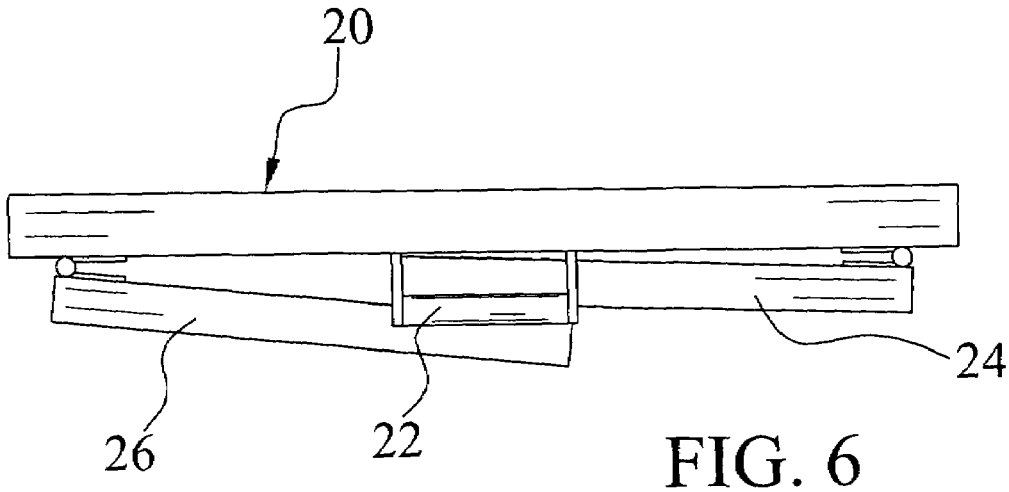
FIG. 6 is a top view of the present invention with the support members folded.
Figure 7:
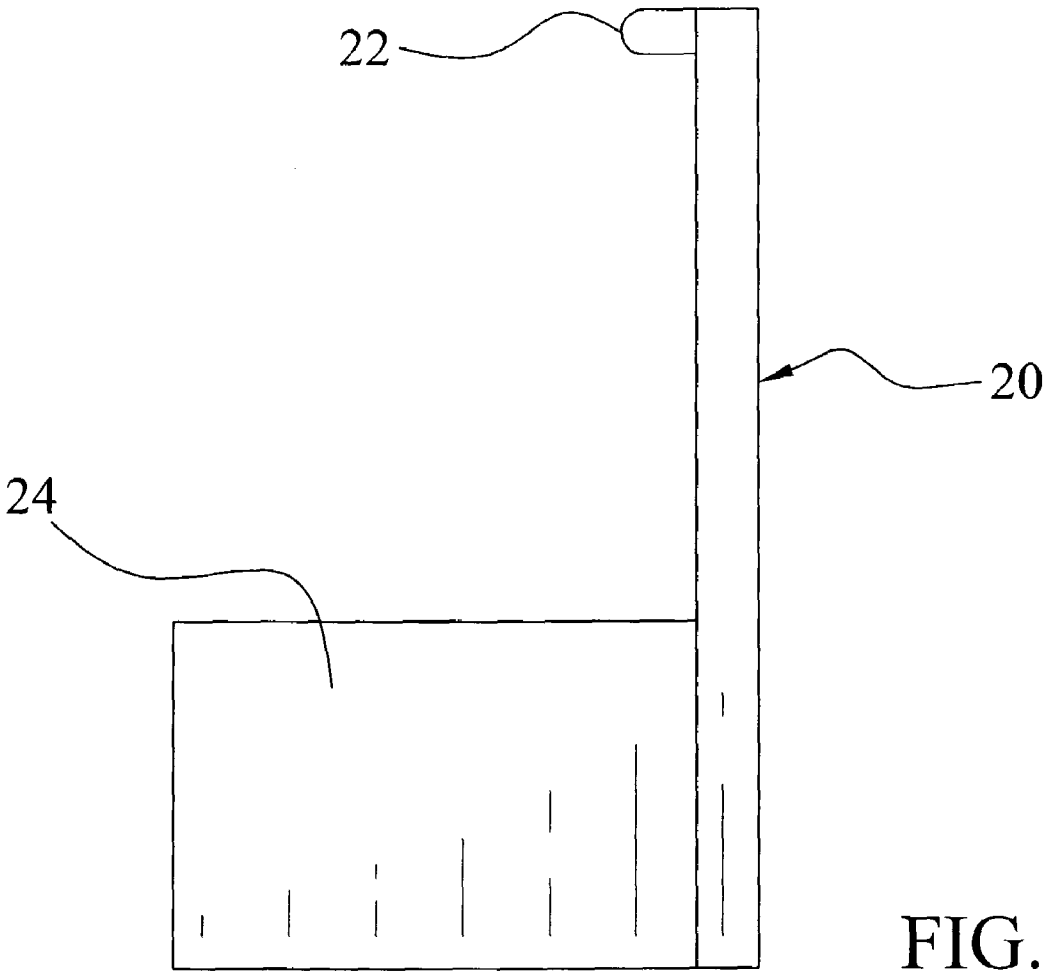
FIG. 7 is a side view of the present invention.

As shown in FIGS. 5 and 6 of the drawings, a first support 24 and a second support 26 are preferably pivotally attached to the side portions of the panel 20 for providing support to the panel 20 in a vertical manner. The first support 24 and the second support 26 preferably pivot inwardly substantially parallel to the panel 20 to form a compact storage position as best shown in FIG. 6 of the drawings. When the first support 24 and the second support 26 are fully extended as shown in FIG. 5 of the drawings, the supports 24, 26 prevent the panel 20 from falling forwardly or rearwardly.

D. Targets

The plurality of targets 40 each preferably are comprised of a square shape positionable within the plurality of openings 30 as shown in FIGS. 1 through 4 of the drawings. The plurality of targets 40 are preferably comprised of a resilient material such as but not limited to sponge, foam, rubber and the like. The plurality of targets 40 are preferably larger than the plurality of openings 30 to allow for frictional engagement of the targets 40 within the openings 30.

Figure 2:
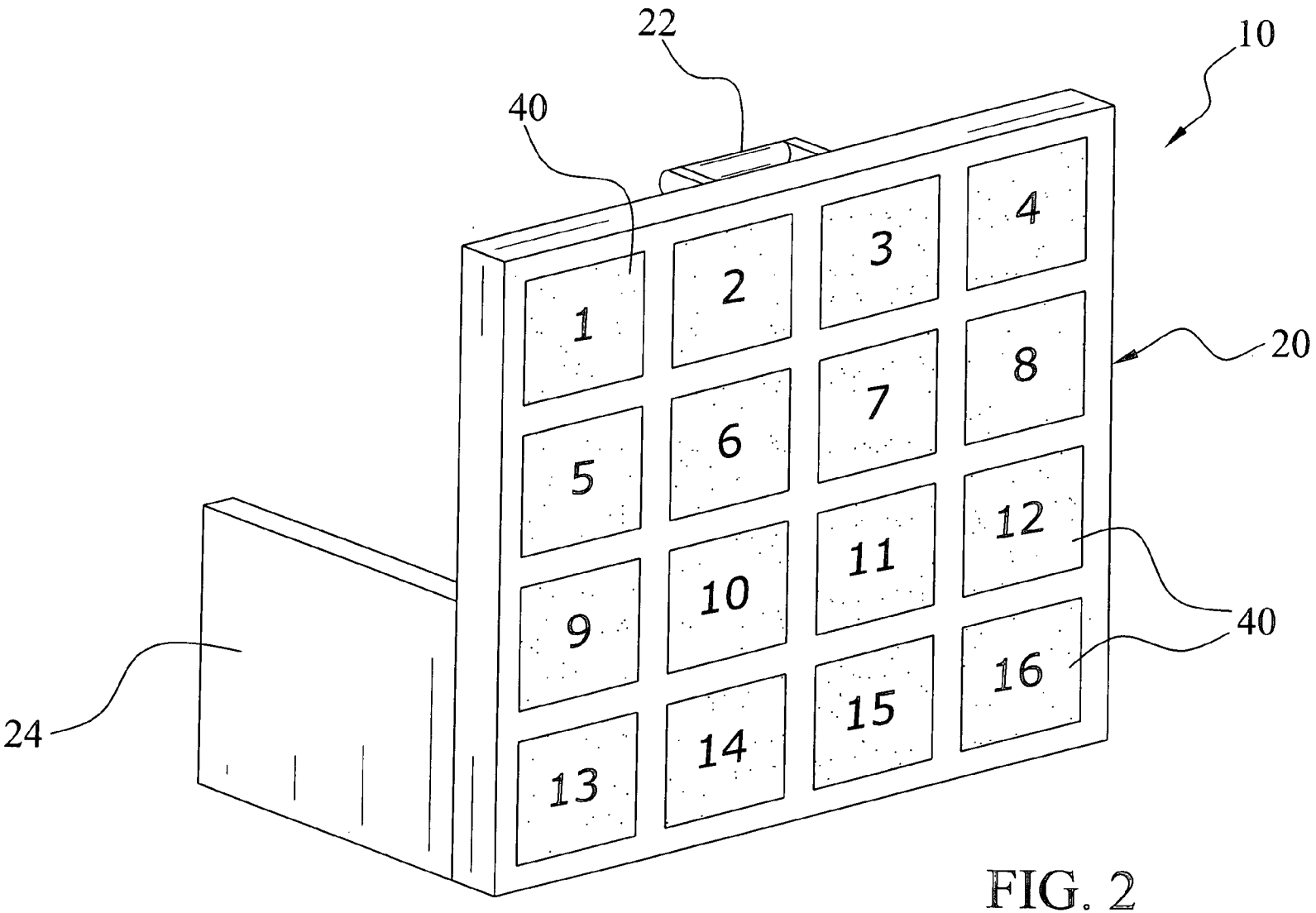
FIG. 2 is an upper perspective view of the present invention.
Figure 4:
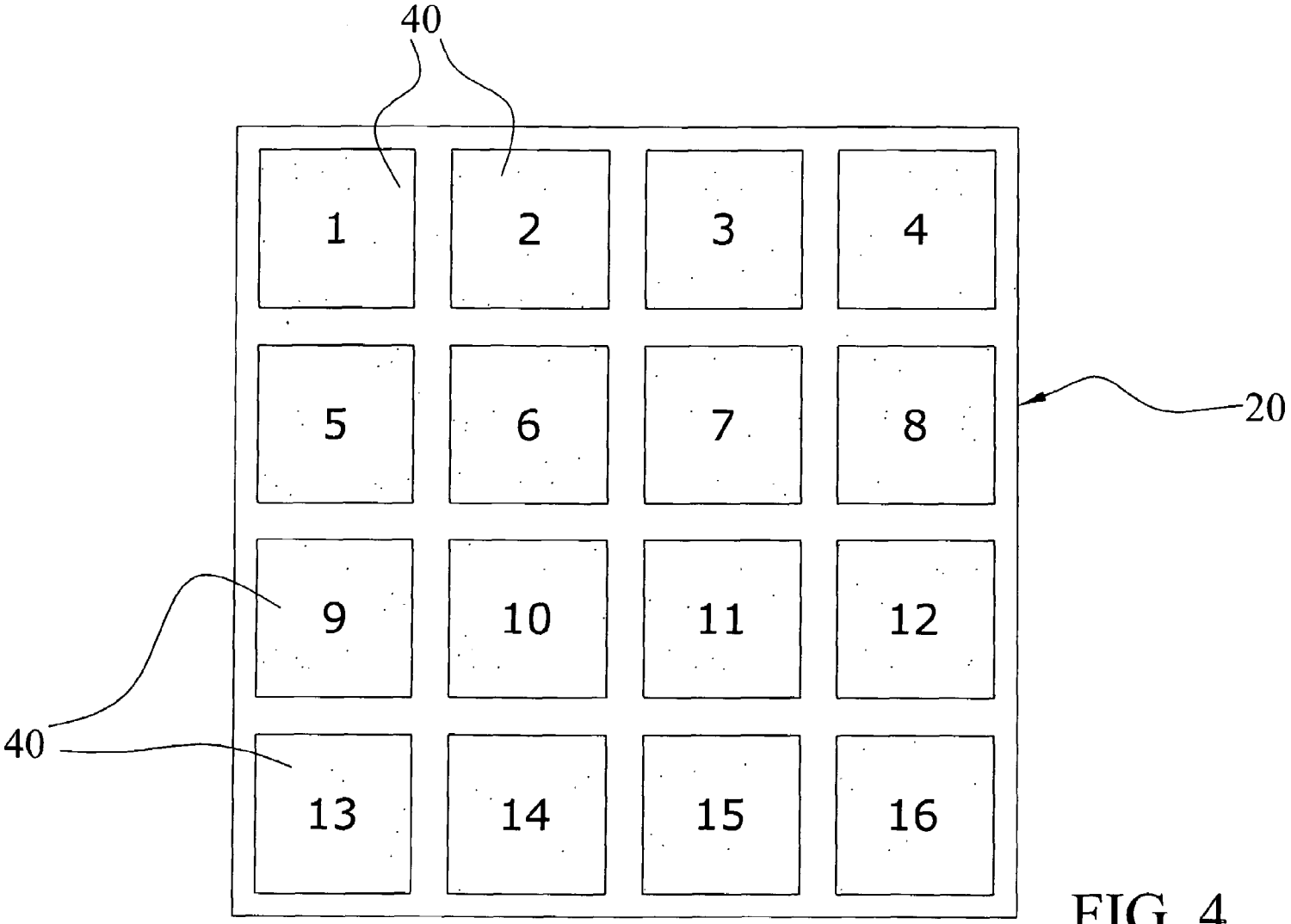
FIG. 4 is a front view of the present invention.

An indicia (e.g. number, letter) is preferably positioned upon each of the plurality of targets 40 as shown in FIGS. 1, 2 and 4 of the drawings. The panel 20 also preferably includes a corresponding number of indicia adjacent each of the openings 30 that correspond to the indicia on the targets 40 thereby indicating where the targets 40 are to be positioned within the panel 20. The targets 40 may also have different colors such as the even numbered targets 40 having a first color and the odd numbered targets 40 having a second color.

E. Goalie Member

A goalie member 50 may also be attached to a front portion of said panel 20 as shown in FIG. 8 of the drawings. The goalie member 50 is preferably shaped to represent an actual goalie thereby illustrating the desired targets 40 to shoot at with the puck 12.

F. Operation of Invention

In use, the user preferably lays the panel 20 flat on the ground surface. The user then inserts the targets 40 into the corresponding openings 30 within the panel 20 thereby ensuring that the front surface of the targets 40 will be aligned with the front surface of the panel 20 as shown in FIGS. 1 and 2 of the drawings. The user then manipulates the panel 20 into an upright position as shown in FIGS. 1, 2 and 4 of the drawings. The hockey player thereafter shoots at the targets 40 with the intention of driving one of the targets 40 from the panel 20 as shown in FIG. 1 of the drawings.

Various games may be played with the present invention. For example, one of the targets 40 may be identified as the "last target" wherein the player who knocks out this identified target 40 is the winner of the game. Another game that may be played includes each player taking a specific color or even/odd numbered group of targets 40 with the goal of driving out their respective targets 40 within the group. Another game includes each player being dealt a plurality of cards with each card corresponding to one of the targets 40 (e.g. Ace to 1, 2 to 2, 3 to 3) where each player attempts to drive out the targets 40 corresponding to the cards in their hand. Another game includes utilizing two panels 20 instead of goaltenders. It can be appreciated that various other games may be played with the present invention.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A hockey practice system, comprising:

a panel including a plurality of openings each comprised of a square shape, wherein said plurality of openings are comprised of at least two vertical rows and/or at least two horizontal rows;

a first support and a second support pivotally attached to side portions of said panel for providing support to said panel in a vertical manner;

a plurality of targets each comprised of a square shape positionable within said plurality of openings, wherein said plurality of targets are comprised of a resilient material and wherein said plurality of targets are larger than said plurality of openings;

a handle attached to an upper portion of said panel; and an indicia positioned upon each of said plurality of targets, wherein each of said plurality of targets has a different indicia.

2. The hockey practice system of claim 1, wherein said panel includes a corresponding number of indicia adjacent each of said plurality of openings that indicate where each of said targets are to be positioned.

3. A method of practicing hockey shooting utilizing the system of claim 1 said method comprising the steps of:

positioning said targets within said openings of said panel;

positioning said panel in a substantially vertical state;

providing at least one hockey puck; and shooting said at least one hockey puck towards at least one of said plurality of targets for the purpose of hitting and dislodging at least one of said plurality of targets with said hockey puck.

* * * * *